US005127653A

United States Patent [19]

Nelson

[11] Patent Number: 5,127,653

[45] Date of Patent: Jul. 7, 1992

[54] GOLF PUTTER

[76] Inventor: Alan F. Nelson, 7777 E. Main, #348, Scottsdale, Ariz. 85251

[21] Appl. No.: 735,790

[22] Filed: Jul. 25, 1991

[51] Int. Cl.[5] ..... A63B 53/04

[52] U.S. Cl. ..... 273/164; 273/167 C; 273/167 F; 273/167 J; 273/169; 273/183 D

[58] Field of Search ..... 273/77 R, 162 E, 163 R, 273/163 A, 164, 81 B, 81.3, 81.4, 79, 80 R, 80 A, 80 C, 80.1, 80.2, 80.7, 80.8, 183 D, 81 R, 167 R, 167 C, 167 F, 167 G, 167 J, 169

[56] References Cited

U.S. PATENT DOCUMENTS 3,632,112 1/1972 Jacobs ..... 273/164 A X
3,708,172 1/1973 Rango ..... 273/164 A
3,779,398 12/1973 Hunter ..... 273/183 D
3,841,640 10/1974 Gaulocher ..... 273/164 A
3,884,477 5/1975 Bianco ..... 273/164 A X
3,967,826 7/1976 Judice ..... 273/167 F
4,073,492 2/1978 Taylor ..... 273/80.2
4,693,478 9/1987 Long ..... 273/164

*Primary Examiner*—William H. Grieb
*Attorney, Agent, or Firm*—Gregory J. Nelson

[57] ABSTRACT

A golf putter having a head with opposite heel and toe sections which are divergent rearwardly to draw the golfer's visual alignment to the sweet spot. A cavity is centrally positioned at the rear of the face configured to resemble a part of the surface of a golf ball to remove weight and provide an additional visual putting alignment guide. The putter has an offset hosel which is adjustably secured to the head at assembly so precise face balancing can be achieved before final permanent assembly of the components.

11 Claims, 3 Drawing Sheets

GOLF PUTTER

The present invention relates to a golf club and more particularly an improved golf putter.

The game of golf has universal appeal due in large part to the mental and physical demands of the game as well as the pastoral setting in which the game is normally played. It has been said that golf is a devilish game played in a heavenly surrounding. The game requires power and coordination for the longer shots and demands a high degree of finesse and skill for short shots, particularly the act of putting the ball on the green. Golf putters are available in a wide range of configurations to appeal to the personal preference of the golfer to provide the proper "feel" when the ball is struck and to assist the golfer in aligning the golf club, ball and cup.

For example, it is known to symmetrically weight balance putters with the principal mass of the putter located behind the face of the putter at the heel and toe of the putter. This design is generally termed heel-toe weighting and is intended to reduce the torque or twisting effect if the ball is slightly mis-struck or struck away from the centerline of mass of the putter head.

In addition to designs which emphasize weight distribution, other putter configurations include designs that have sighting or alignment features which assist the golfer in properly aligning the club, golf ball and cup. Various putter designs can also be found in which a portion of the putter head is relieved or removed to reduce the mass of the putter head. In some cases, the relieved area accommodates a golf ball so that the putter head can be used to easily scoop or lift the golf ball from the cup.

For example, U.S. Pat. No. 3,779,398 shows a golf putter in which the club head has an arcuate rear surface and a top surface with a recess therein. The recess in the top surface is generally in the shape of a semicircle which opens to the rear of the club so that the club head may be inserted into the cup to scoop balls without the golfer having to bend over. The arcuate shape of the rear of the putter and the arc described by the sides of the recess assist the golfer in aligning the putt.

U.S. Pat. No. 3,632,112 shows a putter head having a golf ball holding cavity in the body of the putter which is dimensioned and configured to encompass more than half of a golf ball for releasably holding a golf ball. The club is provided with sight lines in the top surface of the putter on either side of the cavity.

U.S. Pat. No. 3,708,172 shows a golf putter having a generally vertically extending hole of circular cross section extending entirely through the head between the top and bottom wall. The hole splits a sighting mark on the top surface of the putter head into forward and rearward segments and divides the head into substantially equal masses in order to counter balance the tendency of the head to twist out of position upon misaligned contact with a golf ball and the putter striking face. The symmetrical wall segments of the rear wall taper rearwardly from the side walls and merge to a point that coincides with a sight groove.

U.S. Pat. No. 3,884,477 shows a golf ball driving head which is provided with a circle of precisely the diameter of the golf ball in the upper surface of the club head which when viewed with the golf ball to be struck, assists in aligning the club and ball.

U.S. Pat. No. 4,073,492 discloses a customized putter which has a ball and socket arrangement so the shaft may be orbitally moved relative to the head to secure the desired position and achieve face balancing.

The term "sweet spot" as used throughout, is used in its normal sense as understood by golfers to designate the spot or location on the face of the club where the mass of the club head is centered. Therefore, the same amount of mass is disposed towards the heel as is disposed towards the toe of the club on either side of the sweet spot. When the golf ball is contacted at the sweet spot, a recognizable, solid and satisfying contact is made between the ball and the club which is often attended by a distinct and solid sound. The experienced golfer clearly recognizes a properly struck shot from the feel and sound which results when this occurs. Striking the ball at the sweet spot eliminates or minimizes the tendency of the twist or turn misdirecting the putt.

In spite of the various features, constructions and designs for putters that can be found in the prior art, there nevertheless exists a need for a putter which combines the advantages of heel-toe weighting in a putter having a configuration which assists the golfer in aligning the putter and focuses the golfer's vision on the "sweet spot" on the face of the putter.

Accordingly, it is a principal object of the present invention to provide a golf putter having heel-to-toe weighting to minimize the torque effects of a mis-struck putt.

It is a further object of the present invention to provide a golf putter which has a configuration with the mass of the putter oppositely distributed at the heel and toe of the putter.

Another object is to provide a putter having a configuration which directs the vision of the golfer to the sweet spot to enhance the probability of a properly struck ball.

It is another object of the present invention to provide a relieved area or cavity at the rear of the face of the putter which cavity has the appearance of a portion of the exterior surface of the golf ball to further assist in properly aligning the ball with respect to the face of the club.

Still another object is to provide a putter design which permits fine adjustments to be made at the time of assembly so precise face balancing can be achieved.

Still another object of the invention is to provide a golf putter which does not visually obstruct the golfer's view of the ball and line when addressing the ball.

Briefly, the present invention relates to a golf putter having a striking face which is generally vertically oriented. Heel and toe sections are located opposite ends of the blade behind the face of the putter. The configuration of the heel and toe sections include a surface or an edge which extends or diverges rearwardly, outwardly and away from the sweet spot on the putter to naturally draw the user's eye to the sweet spot. An intermediate body portion is provided behind the sweet spot and has a generally hemispherical recess or cavity approximating or resembling the exterior shape of a portion of a golf ball. The cavity may be smooth or preferably is provided with male or female dimples similar to those on the exterior of a golf ball. This configuration serves to remove weight from behind the sweet spot, provides a higher moment of inertia and also provides a visual reference to assist the golfer in properly aligning and striking the ball at the sweet spot.

In addition the present invention provides a design and manufacturing technique for face balancing the putter which permits relative adjustment of the head and hosel and attached shaft at the time of final assembly.

The above and other objects and advantages of the present invention will be more fully understood from the following description, claims and drawings in which:

Figure 1:
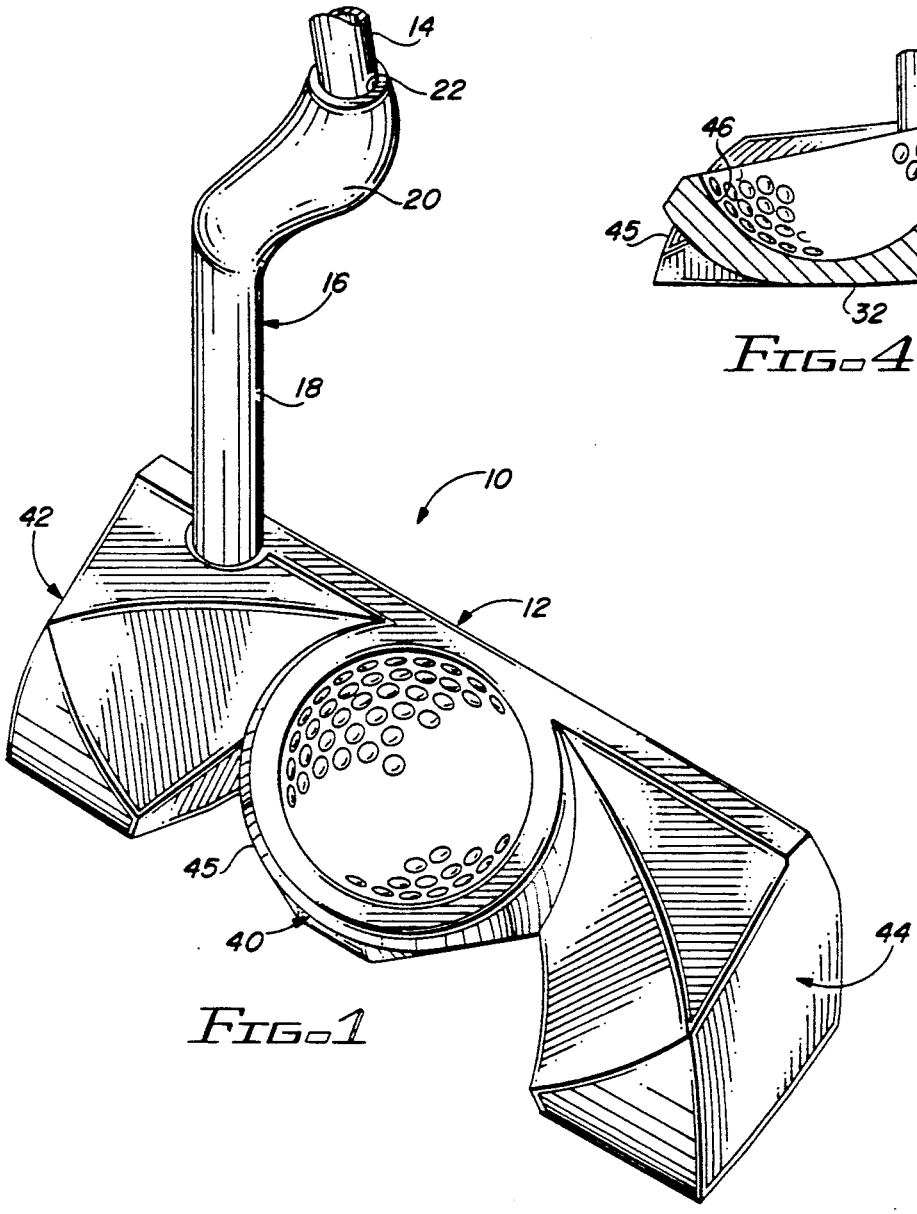
FIG. 1 is a top perspective view showing the golf putter of the present invention.
Figure 4:
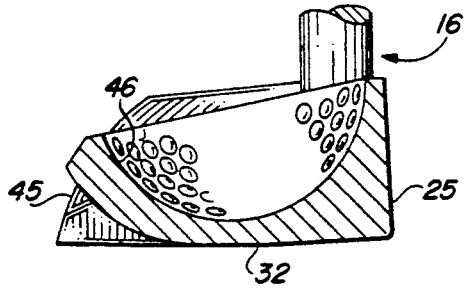
FIG. 4 is a sectional view taken along lines 4—4 of FIG. 2.

Referring to FIGS. 1 to 5, the putter of the present invention is shown and is generally designated by the numeral 10 and includes a head 12 attached to shaft 14 at hosel 16. The hosel is shown as having a generally vertical section 18 and offset section 20 which section defines a bore 22 which receives the lower end of the shaft 14. The shaft is connected to the hosel. As seen in FIGS. 1 an 5, the vertical section 18, offset 20 and bore 22 are relatively positioned so the upper end of the hosel at the point of attachment to the shaft is forward of the face 25. The upper end of the hosel section 20 is displaced from section 18 in a direction toward the toe. However, the offset 20 when viewed at address does not project beyond a line $L_1$ tangent to the periphery of a properly positioned ball which line $L_1$ is parallel to the intended ball path $L_2$. Thus, the shaft and hosel do not visually obstruct or interfere with the putting procedure.

Figure 6:
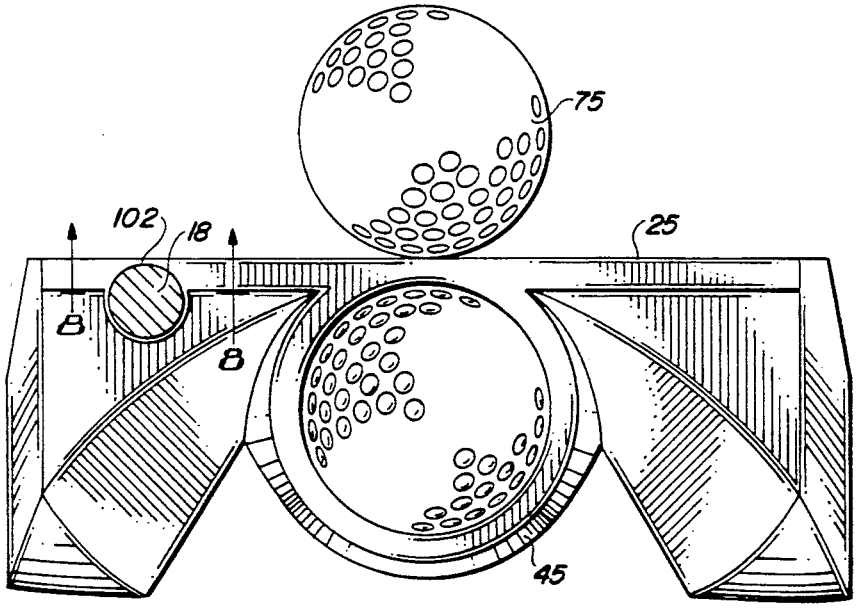
FIG. 6 is a top view of the putter head in a face balanced position.
Figure 7:
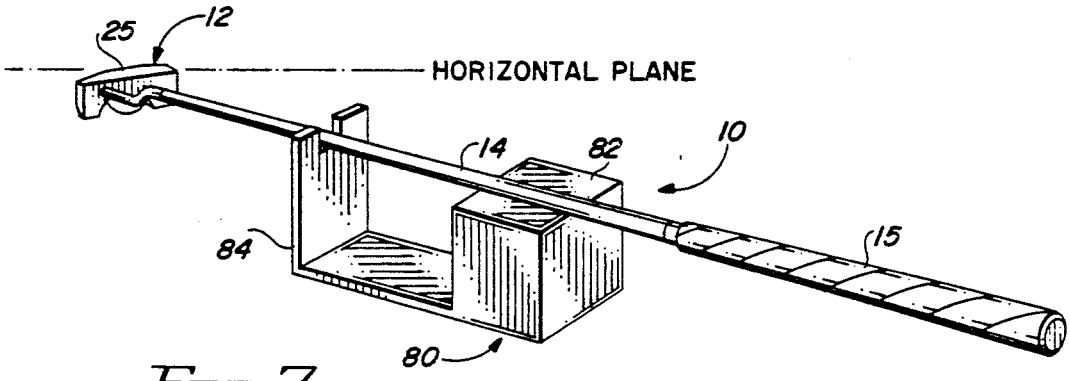
FIG. 7 shows the putter supported on a stand to determine whether the club is face balanced.

The upper end of the shaft is conventional and terminates at a grip 15 shown in FIG. 7. The lower end of the hosel is attached to the head of the putter in a manner which facilitates face balancing at an assembly as will be explained with reference to FIGS. 6 to 8. The putter head and hosel may be fabricated by any conventional method such as investment casting, forging or powder injection molding from materials such as stainless steel, brass, bronze, aluminum or an alloy of these materials. Similarly, the head may be milled or machined as required. The particular manufacturing techniques and materials are a matter of choice.

The putter head includes a vertically oriented striking face 25. The terms "vertical" and "horizontal" are used herein for reference with respect to the putter in its normal position of use. The face is defined by a generally horizontal top edge 26, opposite ends 28 and 30 and bottom surface 32. The bottom surface 32 may be substantially horizontal or may be slightly curved having a sole radius as shown to avoid scuffing the heel or toe of the putter when putting. The putter head is basically symmetrical with respect to the vertical and horizontal centerlines designated by "CL" along which the "sweet spot" 55 is located. The center of gravity is also located along line CL.

Figure 2:
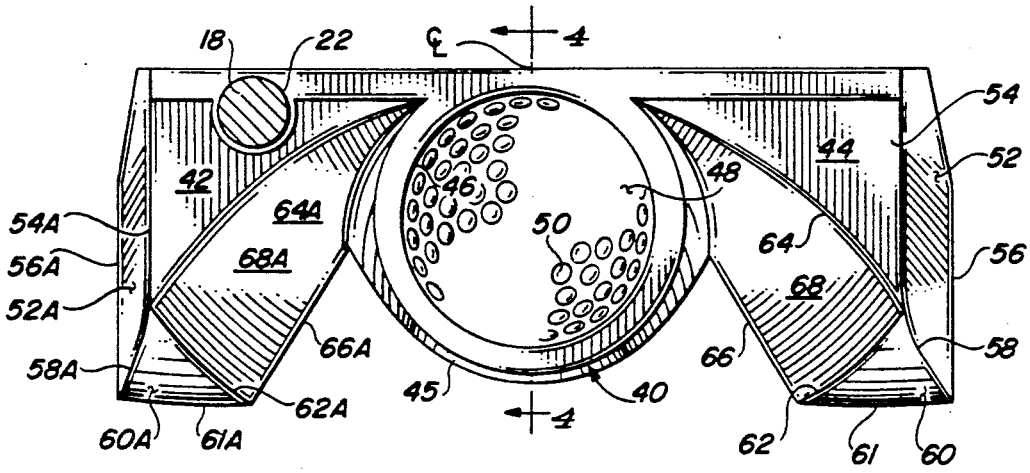
FIG. 2 is a top view of the putter of the present invention.
Figure 3:
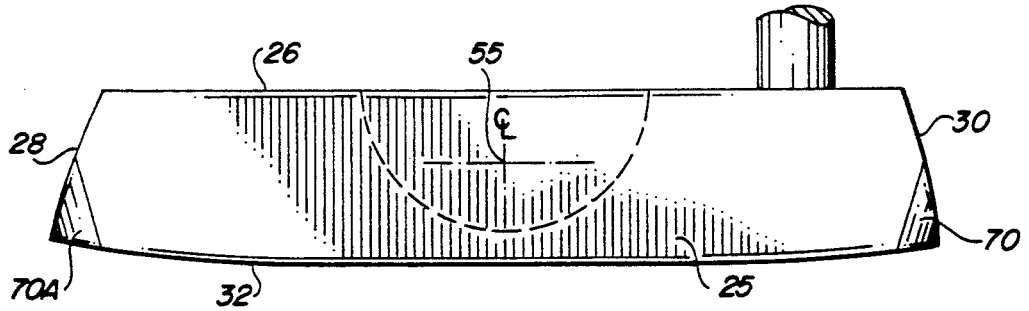
FIG. 3 is a front view of the putter of the present invention.

As best seen in FIGS. 1, 2 and 3, the putter head includes a rearwardly extending intermediate section 40 and heel and toe sections 42 and 44, respectively. Intermediate section 40 is symmetrically positioned immediately behind the sweet spot and has a rear wall 45 which is convex as seen in FIG. 2 and which forwardly curves to intersect the bottom surface 32 of the putter. The section 40 defines an upwardly opening cavity or recess 46 having a diameter corresponding approximately to the diameter of a conventional golf ball. As shown, the cavity 46 is approximately hemispherical although the cavity may be less than hemispherical. It is important that the cavity when viewed from above gives the golfer the visual impression of a substantial portion of a golf ball. Thus, surface 48 preferably covers an area equal to at least approximately one-fourth the area of the exterior surface of a regulation golf ball. The interior surface 48 of the cavity is curved and may be smooth but preferably has dimples 50 which may be concave or convex and provide an appearance corresponding to the appearance of the exterior of a golf ball. As will be more fully explained hereafter, the cavity serves to relieve weight from the putter head in an area behind the sweet spot and also provides a visual aiming reference device which when viewed above in the normal putting stance, resembles a golf ball. This visual device is then aligned with the golfer's ball positioned at the face of the putter to assist in lining up the putts and contacting the ball with the sweet spot of the putter.

The heel and toe weighting sections 42 and 44 are each similarly configured and extend rearwardly from the heel and toe of the putting face. The toe section has an end wall 52 defined by generally horizontally extending spaced apart top edge 54 and bottom edge 56. The end wall 52 extends rearwardly terminating at generally vertical rear edge 58. The rear wall 60 is generally triangular defined by edge 58, lower horizontal edge 61 and inner side edge 62. The rear of the top surface of the toe section is defined by an edge 64 which diverges rearwardly and outwardly from a location at the rear of the blade intersecting the cavity wall 45 to the distal end at surface 52. A lower edge 66 extends rearwardly and outwardly from a location intersecting the lower portion of the cavity wall to the point intersecting edges 60 and 62. Edges 64 and 66 may be linear or as shown are preferably slightly arcuate and along with edge 62 define arcuate surface 68 which is somewhat triangular in shape as viewed from the top as seen in FIG. 2.

It will be noted that the continuation or projection of the edges 64 and 66 extend approximately centerline ("CL") which is located on the face of the club.

The heel section 42 is configured similar to the toe section 44. For purposes of convenience, similar components are designated by the same numeral with the letter "A" being appended as applied to the construction of the heel section. The heel section has an end wall 52A which extends rearwardly from the face of the club having an upper edge 54A and a lower edge 56A.

The heel piece end wall 52A is defined by generally horizontally extending, spaced-apart top edge 54A and bottom edge 56A. The end wall extends rearwardly terminating at vertical rear edge 58A. The rear wall 60A is shown as being generally triangular defined by edge 58A, lower horizontal edge 61A and inner side edge 62A. The rear of the top surface of the heel piece is defined by an edge 64A which diverges rearwardly and outwardly from a location at the rear of the blade intersecting the cavity wall 45 to the end surface 60A. A lower edge 66A extends rearwardly and outwardly from a location intersecting the lower portion of the cavity wall to a point intersecting edge 60A. Edges 64A and 66A may be linear or, as shown, may be slightly arcuate and along with edge 62A define an arcuate surface 68A which is somewhat triangular in shape as viewed from the top as seen in FIG. 2. Again, it will be noted that the continuation or projection of the edges 64A and 66A extend approximately to the centerline of the club on the face as indicated. Thus, this configuration provides heel and toe sections each with a center of mass displaced horizontally from the centerline of the club to provide heel/toe weighting which minimizes the effect of the mis-struck putt. Further, the configuration having heel and toe section with outwardly diverging edges 64, 66, 64A, 66A or surfaces 68, 68A which tend to draw and focus the player's vision toward the sweet spot of the club which lies on the face of the putter along a vertical plane extending rearwardly diametrically through the cavity 48.

As best seen in FIG. 3, the bottom surface or sole 32 of the putter is slightly arcuate to minimize the tendency of the golfer to scuff or engage the turf with the club during the putting stroke. Sole curvature may also extend rearwardly for this purpose. In addition, the outer ends of the heel and toe are provided with facets 70 and 70A, respectively, extending rearwardly from the face of the putter. The facets are provided to eliminate sharp points or projections at the opposite ends of the putter further reduce any scuffing tendency during the putting stroke.

The putter of the present invention can be manufactured by different techniques and made from various materials as is customary in production of golf clubs. Typically, the putter would be investment cast from material such as brass, aluminum or steel. The putter may also be machined or milled from these materials. State-of-the-art materials such as various polymers such as Lexan and the like may also be used for the body of the club in which case the face would normally be in the form of a bronze or brass insert attached to the putter body. The putter can be suitably finished such as by sandblasting, tumbled or coated as by powder coating techniques or the like.

In use, the putter of the present invention provides the golfer with the "feel" which is so important to golfers and is often a very subjective feature. In addition, the putter design assists the golfer in aligning the putt and assists the golfer in properly striking the ball at the sweet spot on the putter face. The heel/toe configuration counter-balances or offsets the torque effect applied to the face of the putter if the ball is mis-struck off the sweet spot or centerline of the club.

Figure 5:
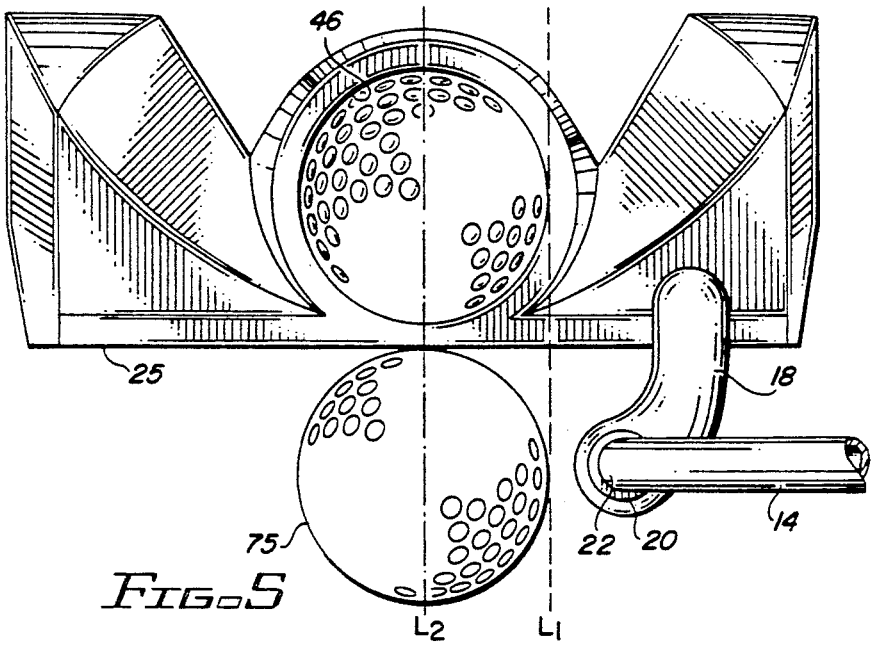
FIG. 5 is a top view of the putter in an address-position which a golf ball positioned at the face of the putter.

In aligning the putt, as seen in FIG. 5, the golfer will place the face 25 of the putter adjacent the ball 75 and the golfer's eye will tend to establish the common axis $L_2$ between the center of the ball and the center of the recess 46 which axis may then be aligned with the target cup. The centrally located recess or cavity 46 in the upper surface of the putter has the shape and size of a substantial portion of a golf ball and may include either small depressions or projections which simulate the dimples on the golf ball. The recess then assists in properly aligning the putt. The overall shape or configuration of the putter, particularly the shape of the rear portion of the heel and toe segments will draw the golfer's eye to the sweet spot of the putter which is at the convergence of the one or more edges or surfaces of the heel and toe pieces. The overall symmetrical configuration also to assists the golfer in aligning the putt and properly striking the ball at the sweet spot, particularly in conditions of actual use where these features combine with shadows and shadings.

In addition to providing a unique putter which assists the golfer in aligning and sighting a putt, properly striking the ball at the sweet spot, and which also provides heel/toe weighting, the present invention also provides a putter which is face balanced. "Face balancing" as used herein, refers to the characteristic of a putter which is weight distributed in a manner so that if the shaft of the putter is freely supported on a horizontal surface in a manner so as to allow the head of the putter to freely assume any position, the putter face will assume a precise horizontal position. FIG. 7 illustrates a putter supported in the manner described with the putter assuming a face-balanced position. The support 80 has a platform 82 which supports the shaft 14 and a slotted upright 84 which engages the shaft near the hosel. The putter is free to rotate to a position at rest determined by the weight distribution characteristics of the putter. If face balanced, the face 25 will be in a horizontal plane. In order to confirm precision face balancing, a level or a golf ball 75 may be placed on the face of a properly face-balanced putter and the golf ball will assume a static position, not rolling toward either end of the putter face as seen in FIG. 6. A face-balanced putter is desirable in that it provides a good "feel" to the golfer and also tends to minimize both the tendency to strike the ball off-center and to minimize the results if such a mis-alignment occurs.

While many golf clubs are claimed by their manufacturer to be face balanced, in fact few are truly face balanced. While the weight distribution and design of a golf club head may be selected to achieve face balancing, various irregularities can occur in the manufacture and assembly process which result in the assembled putter not having true face-balancing characteristics. This may be due in part to variations in the density of the material of the putter. Even though a putter configuration is face balanced, the weight distribution due to inconsistency in the density of the material such as a cast bronze can effectively impair the proper balance of the finished product. Further assembly, particularly attachment of the shaft and hosel, if not precise, can also have this same effect.

Accordingly, the present invention provides an assembly method for a putter which allows the assembler to make fine adjustments at the time of final assembly to accommodate for irregularities which would otherwise adversely affect the desired face-balancing feature.

Figure 8:
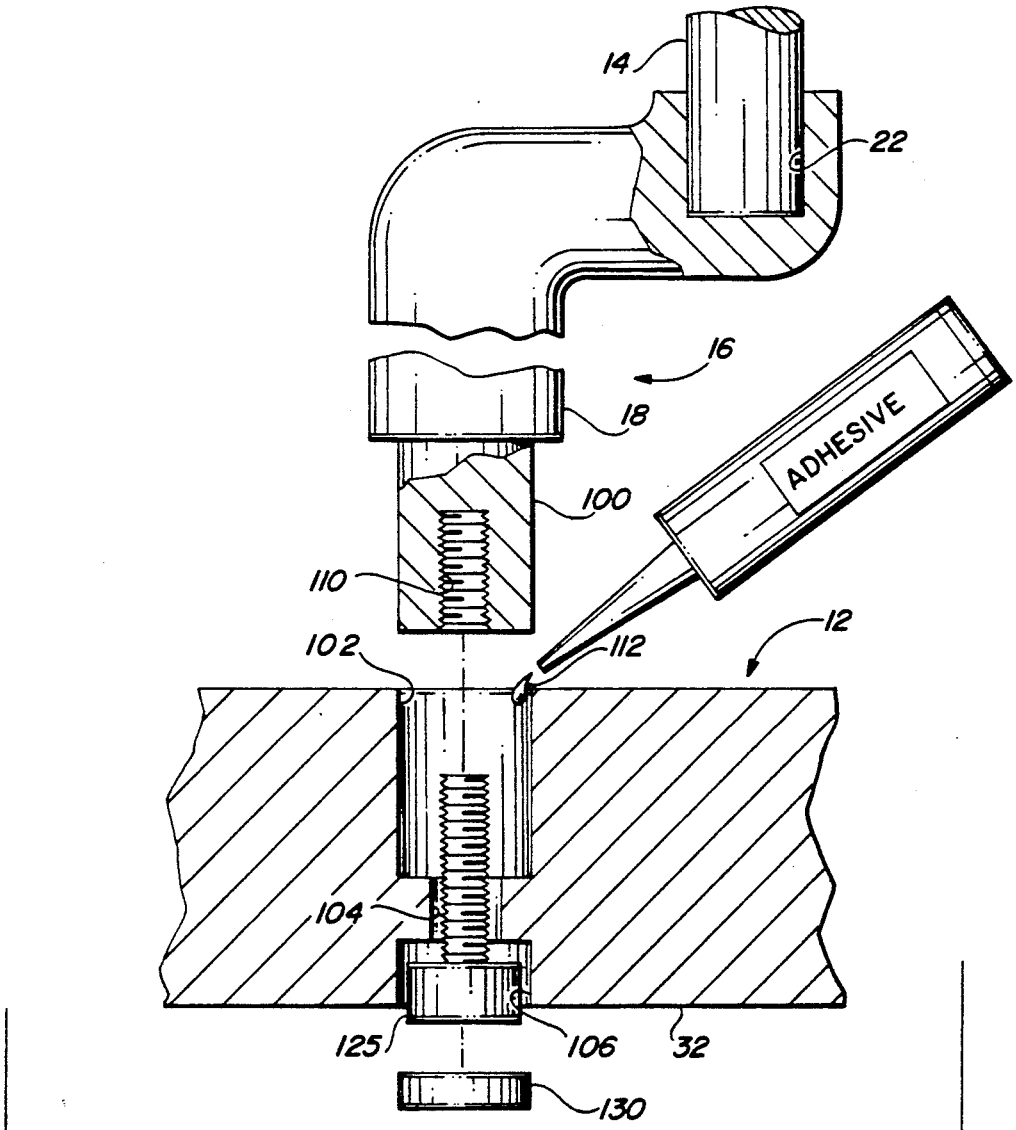
FIG. 8 is an exploded sectional view taken along lines 8—8 of FIG. 6 illustrating the attachment of the club head and shaft to permit fine assembly adjustment for proper face balancing.

As seen in FIG. 8, the hosel 16 is of the off-set type having an upper end 20 which receives the shaft 14. The upper end of the hosel is provided with a blind bore 22 which receives the lower end of the shaft 14. The angle of the blind bore 22 with respect to the axis of the hosel body 18 is selected to provide the desired club lie which is primarily a matter of user-preference. The shaft 14 for example may be disposed in the bore 22 so as to have an axis generally upright and parallel to the hosel or the shaft may be angled rearwardly. Once the desired shaft angle is determined, the upper end of the hosel is appropriately bored and the lower end of shaft 14 is inserted into the complimentary bore and secured therein as by use of suitable adhesives such as an epoxy completing the shaft and hosel assembly.

The lower end of hosel 16 is provided with axially extending undercut stub shaft 100 which is generally cylindrical having a diameter less than the major diameter of the hosel and a length less than the overall height of the putter. The projection 100 is provided with a threaded counter bore 110 extending axially from the outer end of the stub shaft projection.

As seen in FIGS. 6 and 8, the heel section of the putter is provided with a vertically extending bore 102 at a suitable position spaced from the end of the heel piece and located behind the face 25 of the putter. The bore 102 is selected to snugly receive the stub shaft 100. A small counter bore or recess 106 is provided in the bottom 32 of the putter and axially aligns with bore 102. The bores 102 and 106 are interconnected by smaller diameter opening 104. A fastener, shown as a cap screw 125, secures the assembly. Once the hosel projection 100 is inserted in bore 102, the cap screw is inserted from the opposite side and placed in threaded engagement with threaded bore 110 and tightened.

In the assembly process, it is preferably that a suitably adhesive 112 such as an epoxy is first placed in the bore 102. Then the hosel and cap screw are arranged as described above and the putter shaft horizontally supported as shown in FIG. 7. The relative position of the putter head to the hosel can be manually adjusted until perfect face balancing is achieved at which point the cap screw is finally tightened and the adhesive allowed to completely set. The head of the cap screw may be left exposed or preferably the suitable sealing plug 130 is placed over the cap screw to form a continuous and smooth surface on the underside of the putter. As has been explained with reference to FIG. 5, the hosel configuration and hosel, shaft and head relationships are selected to eliminate visual interference with the putting procedure.

It will be obvious to those skilled in the art to make various changes, alterations and modifications to the golf club and method of making a golf club described herein. To the extent that such changes, alterations and modifications do not depart from the spirit and scope of the appended claims, they are intended to be encompassed therein.

I claim:

1. A golf putter comprising:

(a) a golf club head having a forwardly facing striking face and top, bottom and side edges and having a sweet spot centrally located on the putter face;

(b) an intermediate body section extending rearwardly from said face in the area of said sweet spot and defining a recess therein having a generally concave surface, said recess being generally positioned behind the said sweet spot;

(c) a toe section disposed rearwardly of said face on one side of said intermediate body section;

(d) a heel section disposed rearwardly of said face on the opposite side of said intermediate body section;

(e) said heel and toe sections being substantially symmetrical with respect to a vertical plane passing through said sweet spot;

(f) said heel and toe sections each having at least one edge diverging generally rearwardly and outwardly and away from said sweet spot on said face which edges along with the recess establish visual reference guides for alignment of the putt and proper striking of the golf ball; and (g) a shaft secured to said head.

2. The putter of claim 1 wherein said putter is heel-toe weighted with substantially equal mass being distributed on opposite sides of the sweet spot.

3. The putter of claim 1 wherein said curved surface is generally concave and hemispherical simulating the appearance of a portion of the surface of a golf ball.

4. The putter of claim 1 wherein said bottom edge is curved in a heel-to-toe direction.

5. The putter of claim 1 wherein said heel and toe sections each have at least two spaced-apart edges diverging generally rearwardly and outwardly and away from said sweet spot to define a viewable surface to assist the golfer in aligning the putt and properly striking the ball.

6. The putter of claim 1 further having a weight distribution which is face balanced.

7. The putter of claim 1 having a head cast of metal.

8. The putter of claim 7 wherein said putter head is powder paint coated.

9. The putter of claim 1 wherein said shaft attaches to the head at a hosel having an offset to minimize visual interference of a golf ball in a proper address position.

10. A golf putter comprising:

(a) a golf club head having a body having top and bottom surfaces with a forwardly facing striking face and having a sweet spot located on the face at the approximate intended golf ball striking point; and (b) said body defining a recess rearwardly of the sweet spot, said recess having a generally concave surface having the size and curvature of at least a substantial portion of the surface of a golf ball which has a projected center that will visually align with the sweet spot to assit the golfer in putting.

11. The golf putter of claim 10 wherein said recess is generally concave and hemispherical.

* * * * *